US007918456B2

(12) United States Patent
Markov

(10) Patent No.: US 7,918,456 B2
(45) Date of Patent: Apr. 5, 2011

(54) APPARATUS AND METHOD FOR VIEWING FACE-DOWN PLAYING CARDS

(76) Inventor: Steven Markov, Morristown, NJ (US)

( * ) Notice: Subject to any disclaimer, the term of this patent is extended or adjusted under 35 U.S.C. 154(b) by 356 days.

(21) Appl. No.: 11/983,507

(22) Filed: Nov. 10, 2007

(65) Prior Publication Data

US 2009/0121428 A1 May 14, 2009

(51) Int. Cl.
*A63B 71/00* (2006.01)

(52) U.S. Cl. ..... 273/148 A

(58) Field of Classification Search ..... None
See application file for complete search history.

(56) References Cited

U.S. PATENT DOCUMENTS 4,146,229 A * 3/1979 Morse ..... 273/150
5,362,053 A 11/1994 Miller
5,393,067 A * 2/1995 Paulsen et al. ..... 273/292
5,681,039 A * 10/1997 Miller ..... 273/148 R
6,290,230 B1 * 9/2001 Anthony ..... 273/447
6,609,715 B2 * 8/2003 Anthony ..... 273/447
7,478,813 B1 * 1/2009 Hofferber et al. ..... 273/148 A
7,575,235 B2 * 8/2009 Belill ..... 273/292
7,594,661 B2 * 9/2009 McLaughlin, Jr. ..... 273/150

* cited by examiner

*Primary Examiner* — Gene Kim
*Assistant Examiner* — Dolores Collins
(74) *Attorney, Agent, or Firm* — Arthur J. Plantamura

(57) ABSTRACT

Disclosed are apparatus and method that allow a card player to identify the face of cards that are dealt face-down to the player and while the cards are maintained face-down. The dealt cards maintained face-down are slid into position onto a transparent window portion in the top planar surface of the apparatus where at least an identifying portion of face-down cards is exposed downward onto a reflecting mechanism which then reflects the image of the identifying portion of the card upward and in normal orientation for viewing by the player.

The apparatus permits a player to comfortably and securely view the identity of face-down cards.

10 Claims, 8 Drawing Sheets

APPARATUS AND METHOD FOR VIEWING FACE-DOWN PLAYING CARDS

The present invention relates to an apparatus and method for viewing an identifying portion of one or more cards placed face-down on the apparatus. More specifically, the present invention relates to apparatus that provides a means for the proper alignment of cards dealt face-down to a player for viewing by the player without lifting the cards from a playing surface on which the cards are dealt. The invention offers a significant improvement in the process the player undergoes to identify player's face-down cards, making the process relatively easier, faster and more secure. The invention also eliminates the need for a player to bend the corners of the face-down cards to secretly identify them, a process which places stress on the cards and tends to mutilate them.

While prior art exists for reading face-down cards such as U.S. Pat. No. 4,146,229 disclosing a table-top reader to assist a handicapped person to view face-down cards placed by an assistant on the reader and U.S. Pat. No. 5,362,053 relating to a device used by a card dealer in the game of Blackjack that uses a deck of cards containing specialized indicia for detection, such prior art lacks the essential advantages of the present invention which assists a player in viewing standard playing cards and maintaining confidentiality of cards dealt face-down to a player.

SUMMARY OF THE INVENTION

The invention provides a device and method for use by a player in a card game during which it is essential that the identity of cards dealt face-down to the player is strictly safe-guarded, i.e., the identity of the face-down cards must not only be hidden from competing players in the game, but also from the prying eyes of any bystanders that might be observing the game. The device comprises planar surface top which permits the device to be integrated within a card-playing table so that the tabletop surface and the top surface of the device are substantially coplanar. The surface top of the device is provided with a transparent surface area or portion (hereafter sometimes referred to as a window or window area portion upon which cards are positioned) and a container or housing below said transparent portion to house a reflecting mechanism that is capable of transmitting at least an identifying portion of cards placed face-down on the window area and refracted upward through a viewing window for reading by the player to whom the cards are dealt.

In use, a player to whom cards are dealt face-down and are kept face-down, to avoid identification by other, slides the cards in position on the transparent window aided by a curb, i.e., a slight ridge or step, and borders to situate the cards on the transparent window. In positioning the cards, the player slides the cards, which may be overlapping, over the curb so that the bottom card is held by the curb and the top card slides over the bottom card and over the curb. Both cards are stopped by borders on the top surface of the device. With the cards thus positioned, an identifying portion of the top, as well as, the bottom face-down card is exposed downward through the window. While the invention, for clarity, is described by reference to the simultaneous identification of two face-down cards, it will be apparent that the invention permits the simultaneous viewing of more that two cards by providing suitably spaced additional curbs that help to position the respective cards, as well as, by correspondingly expanding the scope of the reflecting mechanism. It would also be apparent that the invention may be used to view a single card and that, if the device is to be limited to the viewing of a single card, the curb may be omitted.

Contained in the housing below the transparent window area is a plurality of reflecting surfaces which may comprise coordinated mirrors as reflectors or may comprise a prism provided with at least two mirrored reflecting surfaces. The reflecting surfaces are positioned at an angle, or formed on the prism, such that a reflection of the identifying portion of the face-down cards located on the window area is reflected downward onto a first reflecting (mirrored) surface and refracted onto a second reflecting (mirrored) surface which, in turn, reflects the image upward through another window portion, which is located contiguous to the window portion on which the face-down cards are placed, permitting viewing of the cards identity by the player.

While the invention may be used as a table-top device, in the preferred embodiment, the device is positioned within an opening in a card-playing table and below the card-playing tabletop surface such that the reflecting mechanism is below the tabletop and the surface top of the device is substantially coplanar with the tabletop surface which facilitates sliding of the playing cards into position on the transparent window area.

DETAILED DESCRIPTION OF THE INVENTION

Figure 1:
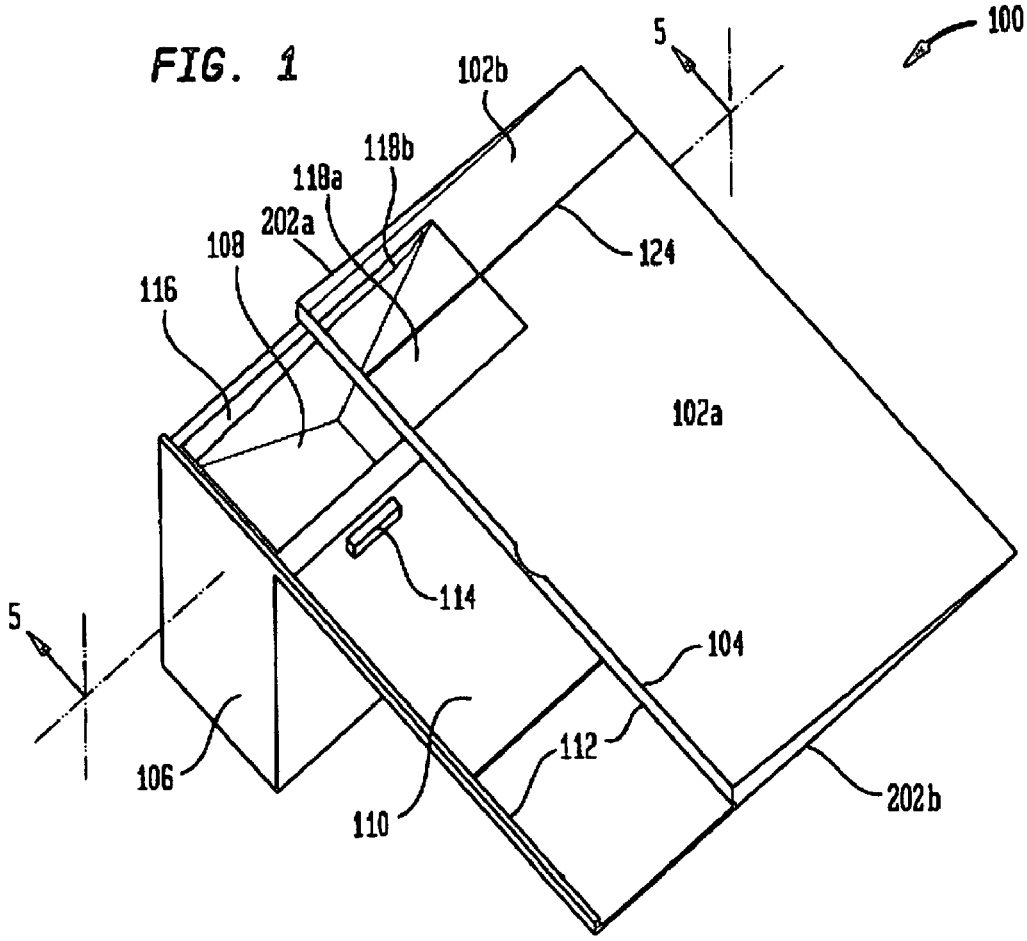
FIG. 1 is a perspective of an apparatus for viewing cards in accordance with one embodiment of the present invention.

Referring to FIG. 1, a perspective view of the preferred reading device 100 of the invention is shown. The device 100 includes top planar surface with a card placement surface 102*a* and a slightly elevated or raised card placement surface 102*b*, border 104, housing 106 containing the reflecting mechanism having a top surface with a transparent window area or portion, sliding door 110, sliding door retainers 112, door handle 114, viewing window 116 through which a player views the identity of the cards placed face-down on windows 118*a* and 118*b*.

Figure 12:
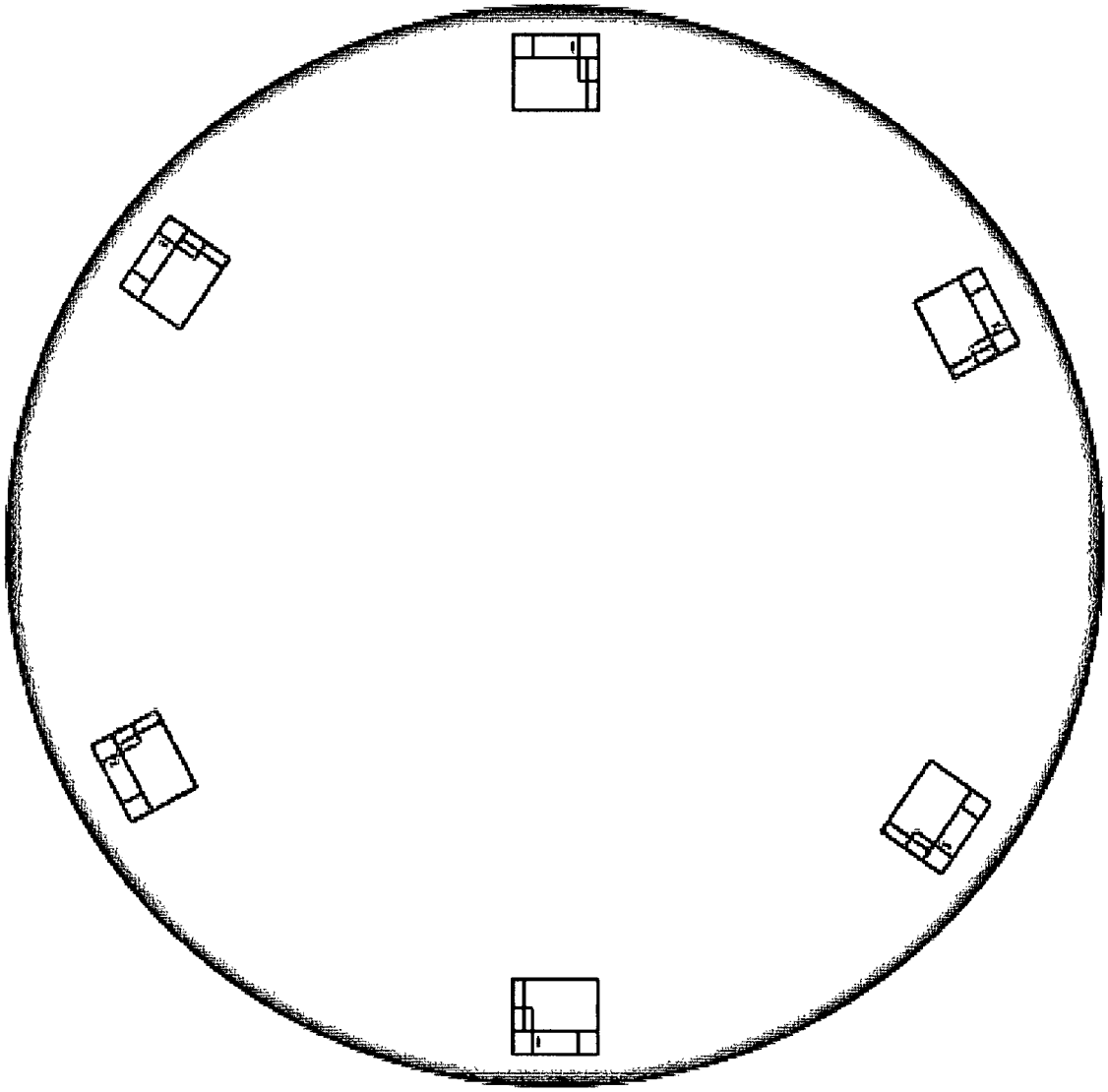
FIG. 12 illustrates a top view of a 6-person card-playing table in which the device of the invention is integrated.

The face-down cards reading apparatus of the invention is devised for use by a single player and it is contemplated that each player will be provided with a reader. For example, as shown in the illustration of FIG. 12, a card-playing table with six player positions is shown, each containing a reader, the top of which is essentially coplanar with the tabletop surface.

The design of card viewer 100 permits the use of a relatively small size viewing window which may be optionally equipped with a privacy screen over, below or within the window 116 of the kind available for computer monitor screens, or a of similar design. A hood placed over the viewing window will obviate distracting reflections, as well as, add to the player's secure observation of the player's cards. A light source may optionally be located adjacent to the reflecting system to illuminate the viewing image.

To view the identify of one or more cards, a player simply slides in sequence cards dealt to the player face-down from surface 102*a* into position on the transparent window area 118*a* abutting against the slightly elevated curb 124, such that at least an identifying portion of each face-down card is visible on receiving window 118*a*. A second card may simultaneously viewed by sliding the second card over to the player's left and overlapping the first card—on the surface shown in FIG. 1—such that an identifying portion of the second face-down card is also visible though window 118*b*. An identifying portion of both face-down cards is reflected upward and viewed by a player through window 116. A sliding door 110, preferably spring-loaded in a closed position, is easily movable to expose the reading window 116 and returned to a closed position manually or automatically where the door is spring-loaded. The closed window additionally safeguards revealing to other players or bystanders the identity of a player's face-down cards. In the embodiment of FIG. 1, container 106 houses a viewing mechanism 108 and supports the top surface a part of which contains transparent card placement windows 118*a* and 118*b*, the viewing window 116 and the sliding door 110.

Figure 3:
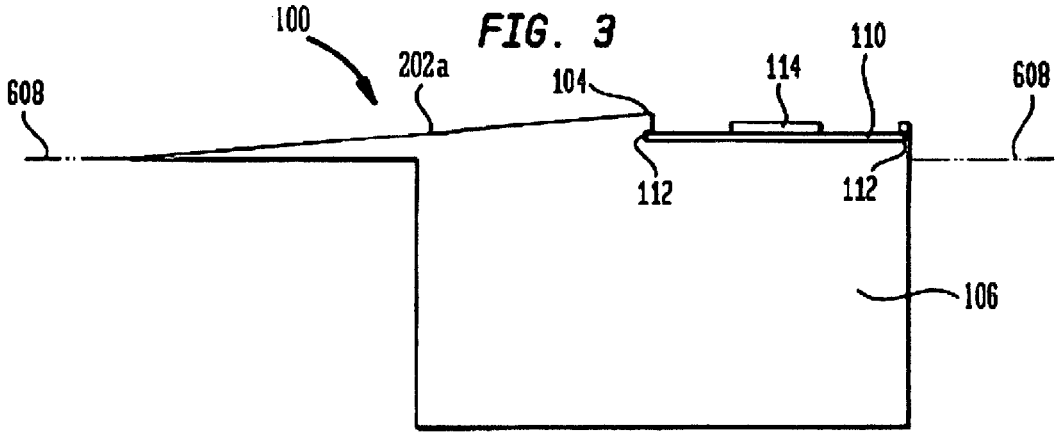
FIG. 3 is a left side view of the apparatus depicted in FIG. 1.
Figure 4:
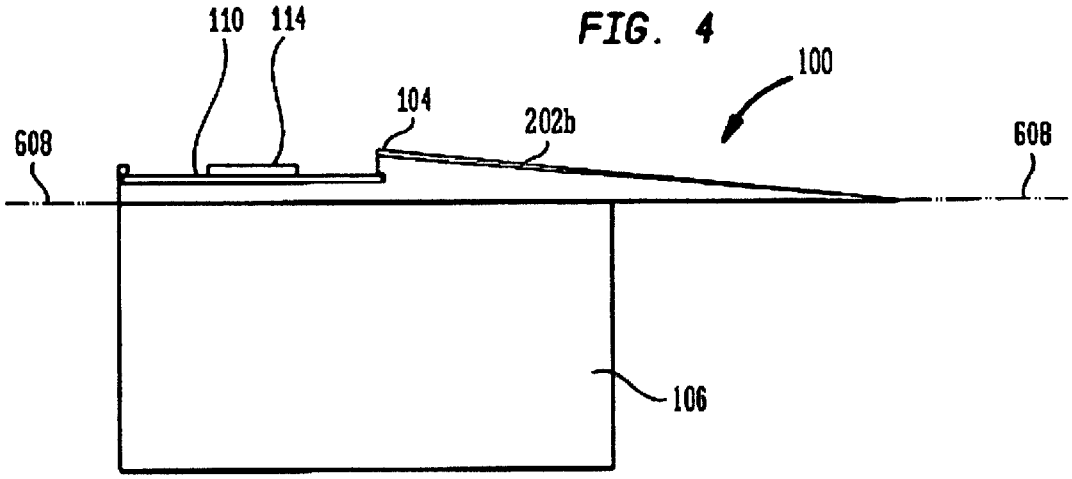
FIG. 4 is a right side view of the apparatus depicted in FIG. 1.
Figure 5:
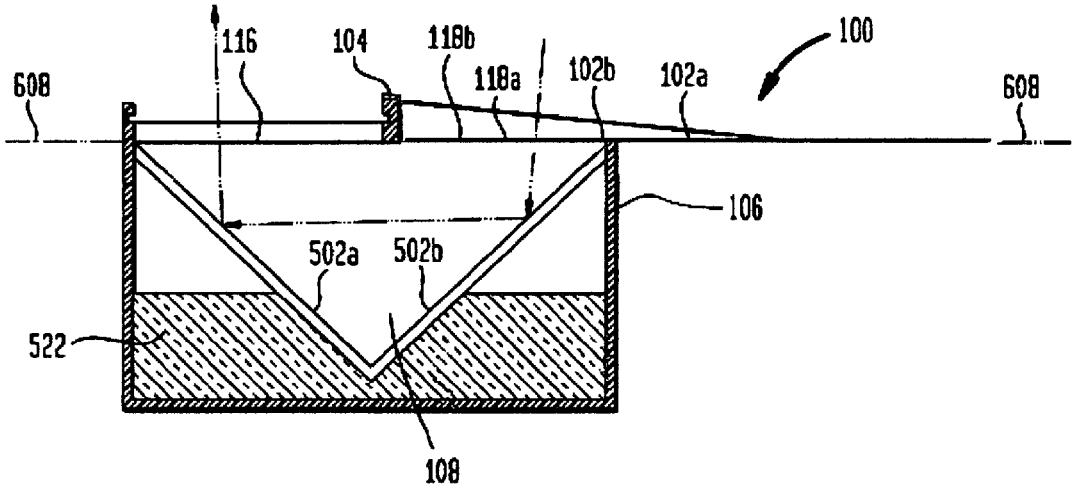
FIG. 5 is a cross-sectional view of the apparatus of FIG. 1 taken along line 5-5 of FIG. 1.

The container 106 which houses a reflecting mechanism shown in FIGS. 3-5 is typically a box-like unit to suitably hold the mechanism and facilitate its positioning in the recess formed in a typical card-playing table.

With reference to the transparent windows areas on which the cards are placed, as previously indicated, window portion 118*b* is slightly higher than the height of the window portion 118*a* such that curb 124 provides a stop and retains the first card and thereby facilitates the passing of a second card so that an identifying portion is viewable though window 116.

In order to preserve the integrity of the device and maintain optimum clarify of the windows, all seams and connections are sealed to prevent dirt and dust from entering the reflecting mechanism container 106.

Figure 2:
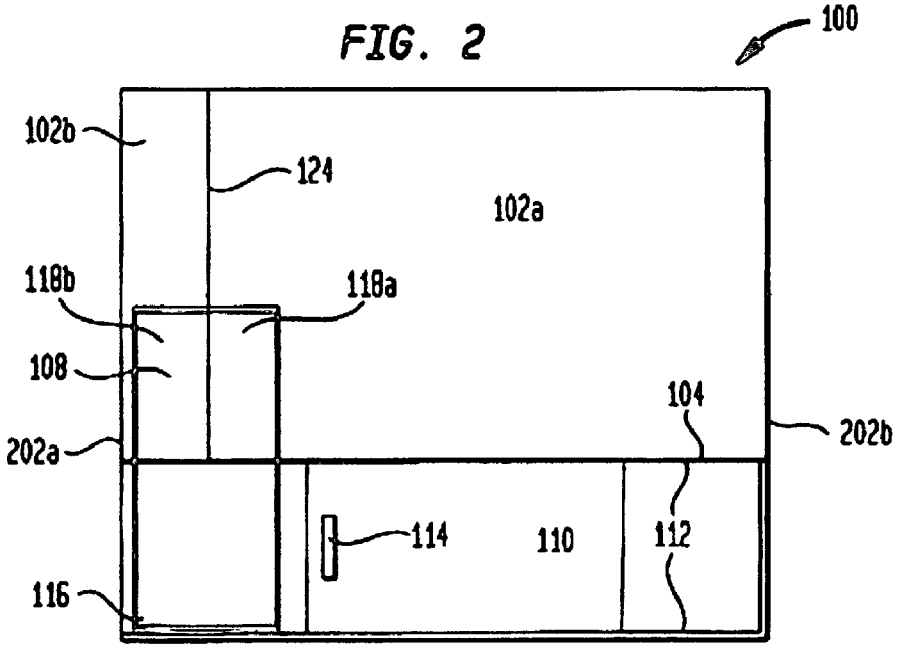
FIG. 2 is a top view of the apparatus depicted in FIG. 1.

The sliding door 110 is preferably spring-loaded to maintain it in a closed position covering the viewing window 116. Although the invention illustrates a sliding door 110, other arrangements such as a pivoting door may be substituted without departing from the essence of the invention. In the top view of card viewer 100 shown in FIG. 2, a slight step or curb 124 is located at the intersection of un-raised and raised card placement top surfaces 102*a* and 102*b* and extends over un-raised and raised window portions 118*a* and 118*b*.

The embodiment of the present invention shown is intended for use with two playing cards. However, the configuration may be adjusted to accommodate more than two cards by the addition of a curb guide for each additional card sought to be displayed simultaneously. The border 104 shown in FIG. 3 coinciding with the inner guide of the sliding door 110 also facilitates correct placement of cards placed on the surface top 102, as well as, on a coplanar surface on which the device is mounted.

FIG. 4 and FIG. 5 illustrate, somewhat exaggerated, the height of border member 104 on the surface of the device 100. The purpose of the border 104 is to facilitate a precise and consistent placement of the face-down cards into position such that a consistent and accurate reading of the face-down cards is achieved.

The reflecting mechanism 108, housed in container 106, is located below windows 118*a* and 118*b* and arranged so as to reflect images of face-down cards placed on windows 118*a* and 118*b*. As shown in FIG. 5 by arrowheads and broken lines, an image from a face-down card on window 118 is reflected by first reflective surface 502*b* then to reflective surface 502*a* and upward for viewing by a player through window 116. Although the viewing mechanism 108 depicted in FIG. 5 is preferably a prism, alternative viewing reflective mechanisms, such as suitably angled, coordinating mirrored surfaces may be substituted without departing from the essence of the present invention.

The reflecting mechanism 108 is secured in position within housing 106 by any suitable means such as mounting in a transparent plastic composition 522.

Figure 6A:
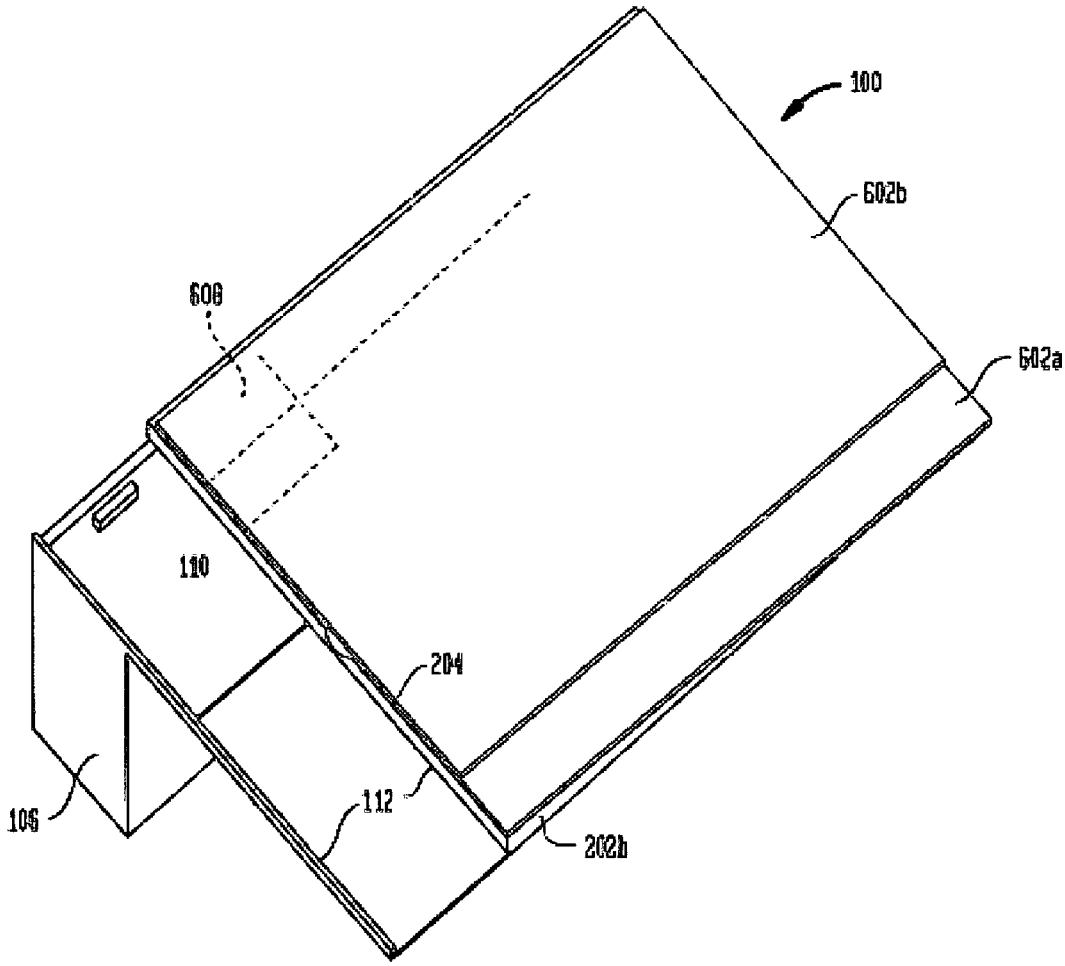
FIG. 6A is a perspective view of FIG. 1 having two partially overlapping cards placed, in a viewable position such that an identifying portion of both cards placed on windows 118*a* and 118*b* (FIG. 1) is viewable through window 116 (FIG. 1) shown covered with a sliding door 110.

In FIG. 6A, the card viewer 100 is shown illustrating a transparent window 118 and curb 124 (shown by broken lines) covered by two face-down standard playing cards 602*a* and 602*b* that are positioned for viewing.

Figure 6B:
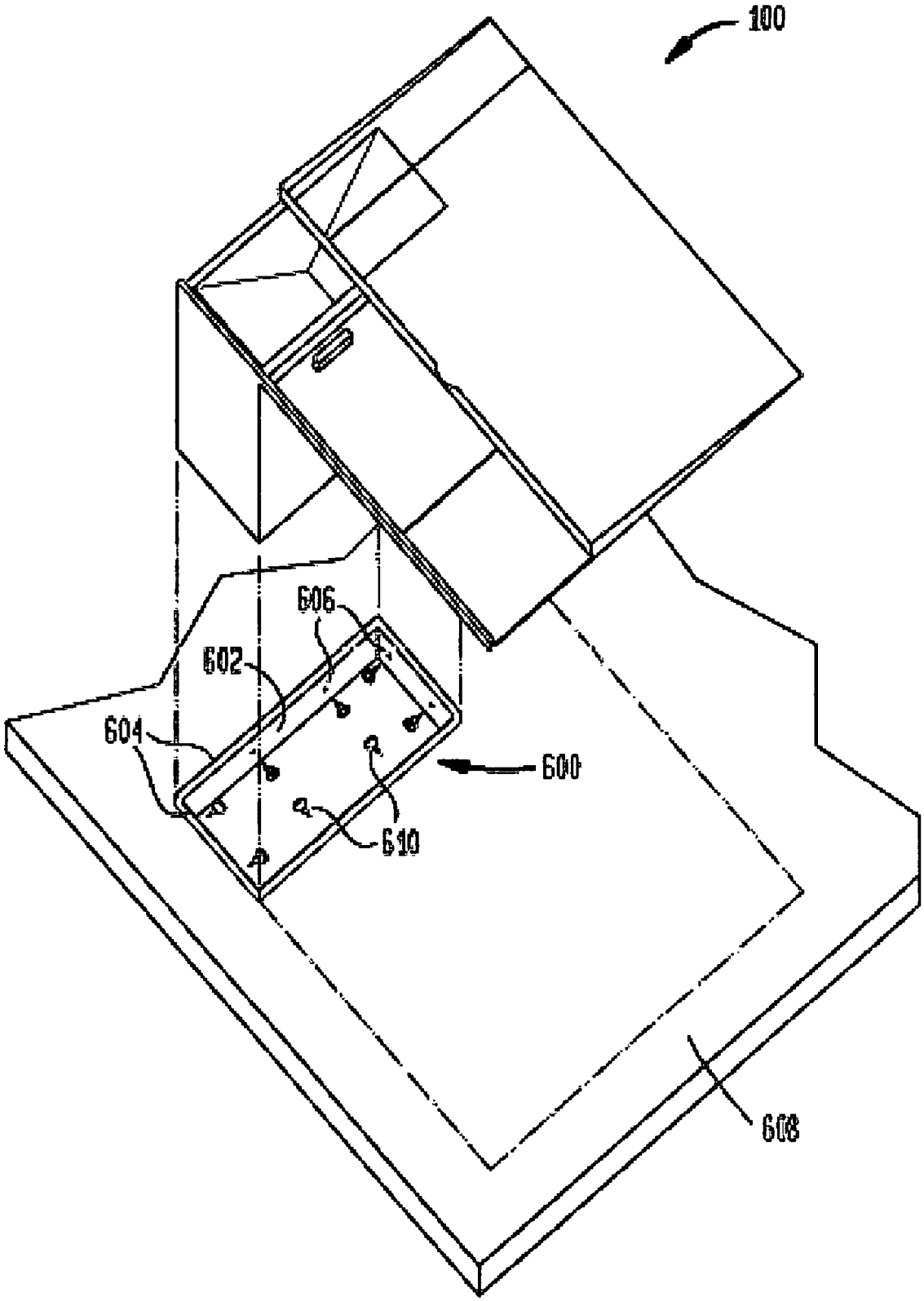
FIG. 6B is an exploded view of the apparatus of FIG. 1 illustrated in conjunction with a segment of a card-playing tabletop and showing a recess formed in the tabletop to receive the apparatus.

A preferred embodiment of the invention illustrated in FIG. 6B shows an exploded perspective view the device of the invention inserted in the top 608 of a card-playing table, a fragment of which is depicted to provide a card-playing table in which the tabletop surface and the top surface of the device of the invention are coplanar.

In FIG. 6B, the insertion of the card viewer 100 into recess 600 may be accommodated with a recess lining 602, suitable flanges 604, and fastener securing apertures 606. Recess 600 may be formed on any appropriate table surface such as a round table of the kind illustrated in FIG. 12. The recess 600 may be formed by cutting an opening in the tabletop 608 of size and dimensions that correspond to the shape of the reflecting mechanism 108, shown more clearly in FIGS. 1, 3-5. The fasteners 610 (e.g. screws, bolts, etc.) are used to secure the reader 100 to the tabletop 608 and in a manner such that the top planar surfaces 102*a* and 102*b* of the device of the invention are substantially coplanar with the surface of the table in which the unit is mounted.

Figure 7:
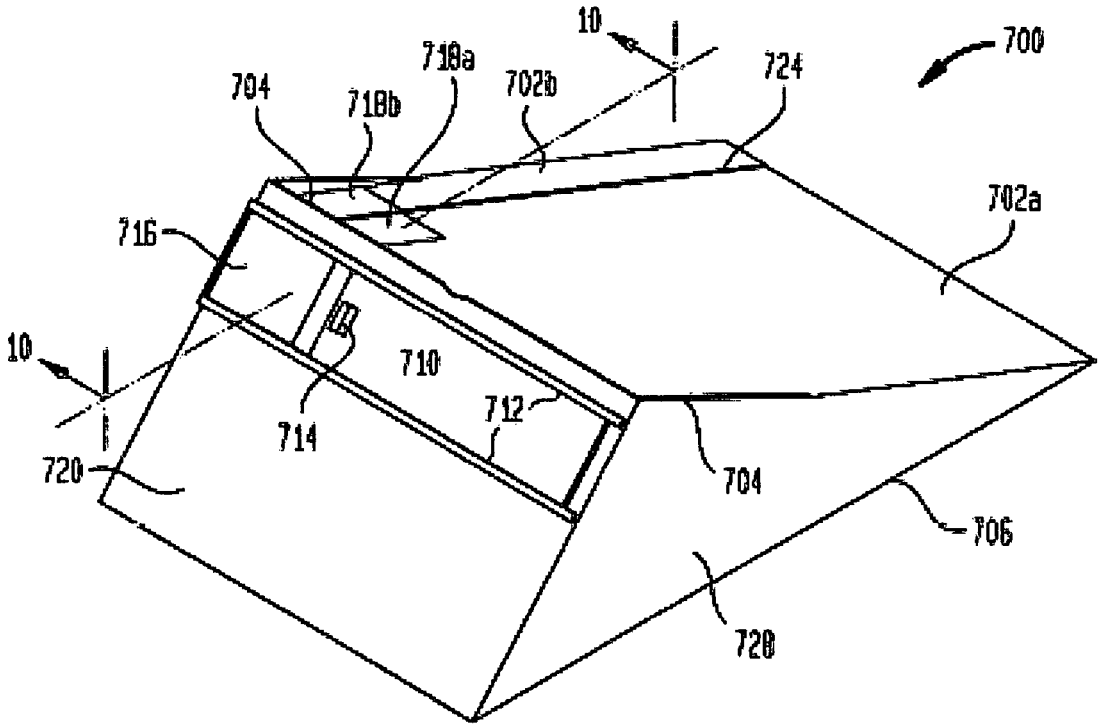
FIG. 7 is a perspective view and an alternate embodiment for viewing face-down cards.
Figure 8:
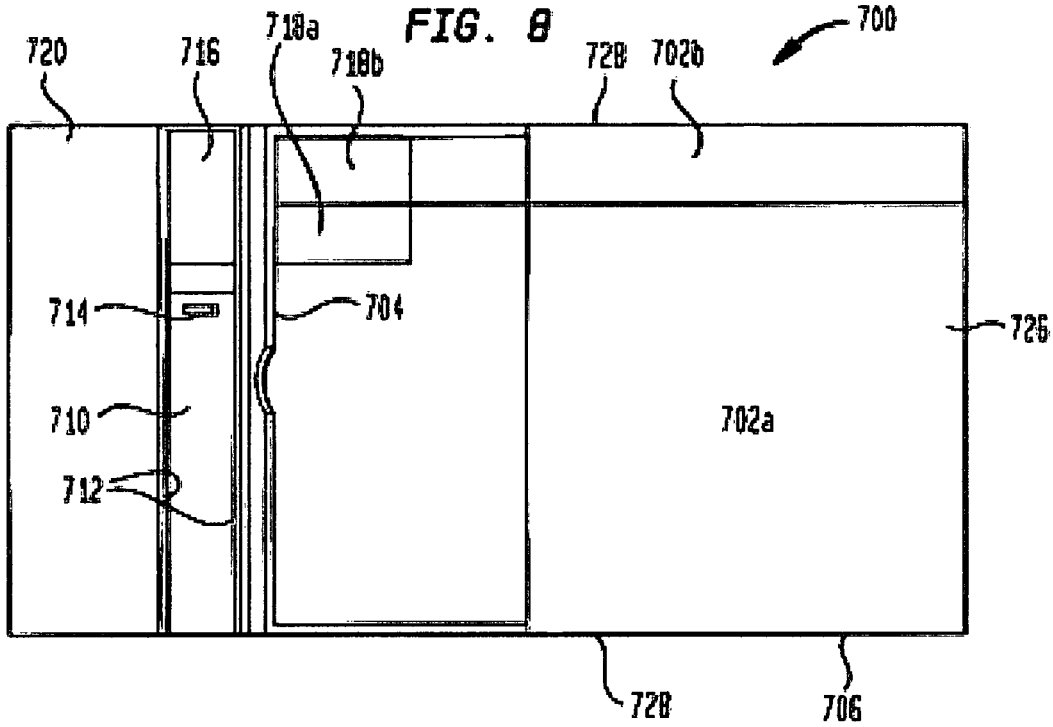
FIG. 8 is a top view of the apparatus of FIG. 7.
Figure 9:
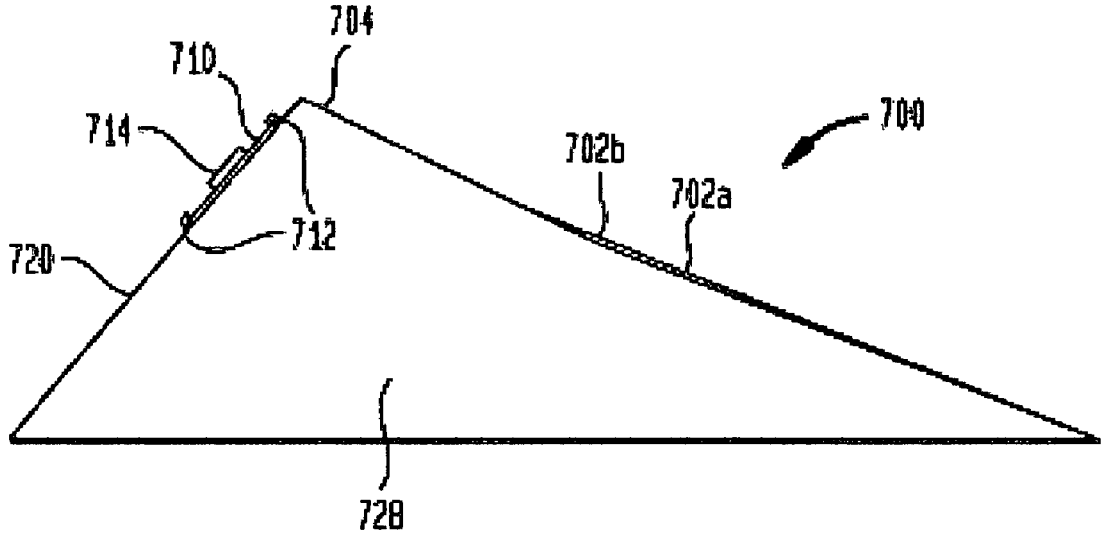
FIG. 9 is a right side view of the apparatus of FIG. 7.

Illustrated in the perspective view of FIG. 7 is an alternative embodiment suitable for free-standing, table-top use. The card viewer 700 includes a card placement surface 702*a* and a relatively slightly raised card placement surface 702*b*, border 704, housing 700 which contains a viewing mechanism 1008 (see FIG. 10), sliding door 710 with handle 714, and sliding door retaining channels 712. Window 718*a* and relatively slightly raised window 718*b* accommodate standard sized playing cards.

When multiple cards are slid into position for viewing, the bottom card abuts the curb 724 and locates for viewing an identifying portion thereof on window 718*a* while the top card slides over the bottom card and the curb and is located, partially overlapping the bottom card, in position with identifying portion on window 718*b*.

Figure 10:
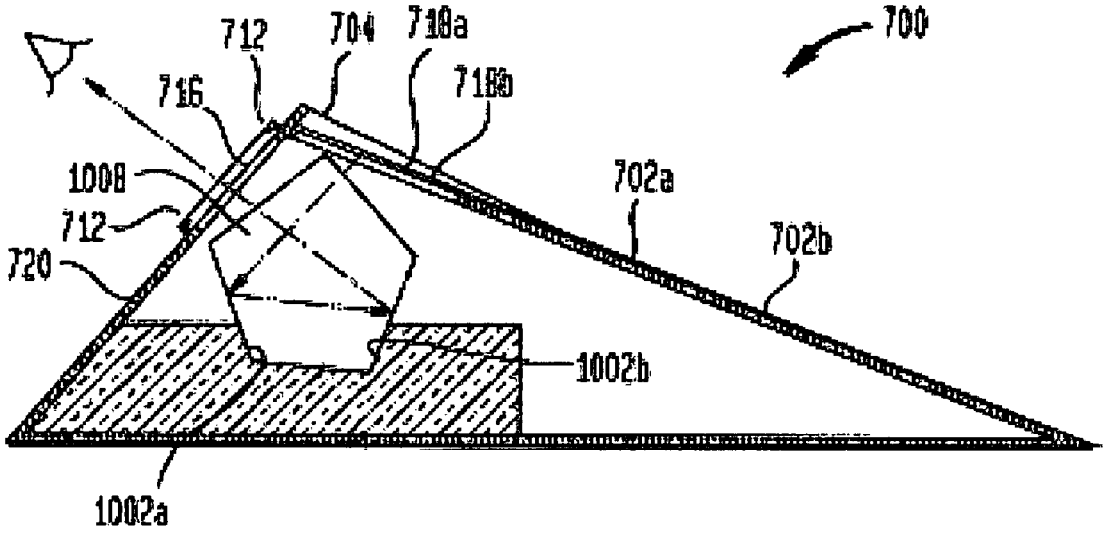
FIG. 10 is a cross-sectional view of taken along line 10-10 of FIG. 7.
Figure 11:
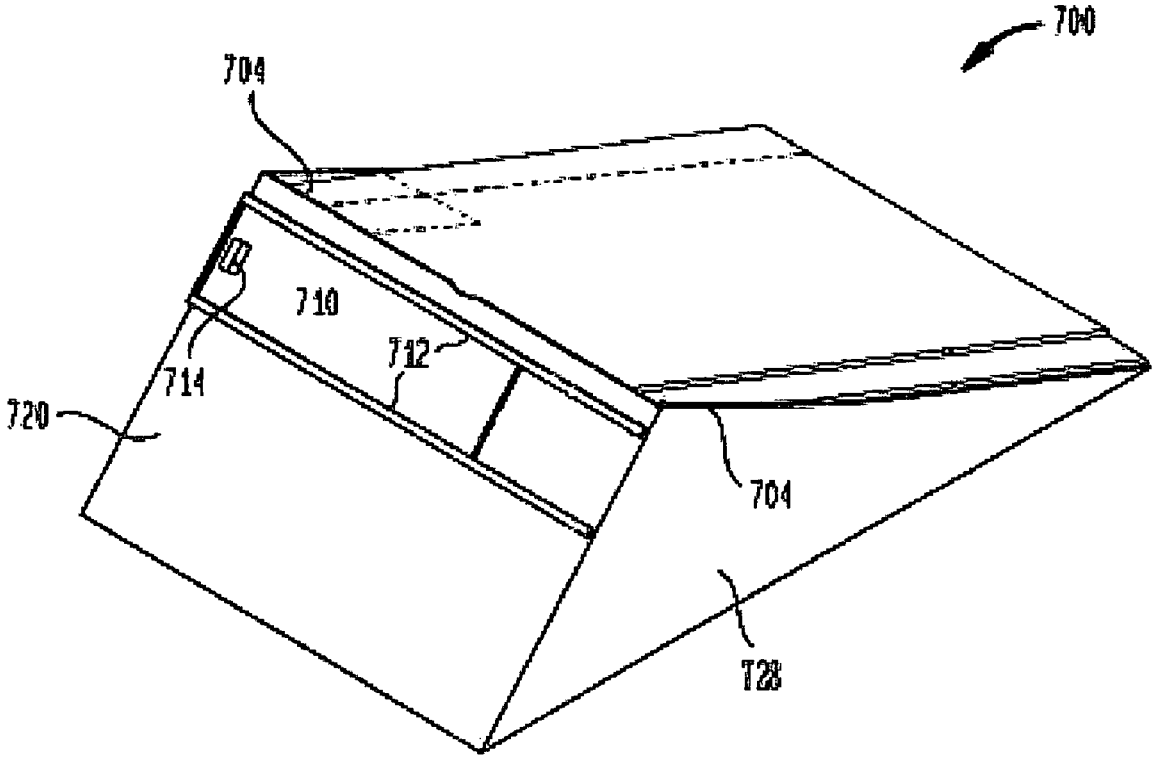
FIG. 11 is a perspective view of the apparatus of FIG. 7.

To view cards on the reader 700, a player simply slides the cards, dealt face-down, into position on the transparent window 718*a* and 718*b*, moves sliding door 710 to a position in which viewing window 716 is exposed and views the reflected image of the face-down cards via the reflecting mechanism 1008 shown more clearly in FIG. 10. When a player has viewed the cards, sliding door 710 is returned to a closed position covering the viewing window 716 providing protection against another person viewing a player's cards. The door 710 may be arranged so as to be held in a closed position when a spring-loaded arrangement for the door is used. In the embodiment in FIG. 7, housing 706 contains the viewing mechanism 1008 (FIG. 10) in addition to providing a support for the top surface containing the transparent windows 718*a* and 718*b*. The upwardly facing surface 702*a* and 702*b* and transparent window area 718*a* and 718*b* have a card placement surface height differential comprising a curb 724 of the kind described by reference to similar components in FIGS. 1-5 to facilitate sliding into location the face-down cards. The forward facing portion of the embodiment of FIG. 7 includes a sliding door 710, door retainers 712, viewing window 716 positioned at the upper part of the panel 720.

The reflecting system contained in the housing of the unit 700 includes a combination of at least two reflecting surfaces and may comprise additional reflecting surfaces depending on the angular position of the reading site and the angle of viewing window of the reflected image.

The top surfaces 702*a*, and 702*b*, front surface 720 and sides 728 are typically formed of suitably opaque or otherwise non-transparent material to prevent other players from seeing the image of cards placed on top of the viewer 700. As previously described by reference to windows 116 in FIG. 1, window 716 optionally may be provided with a privacy screen or hood. Also as previously discussed with reference to card placement windows 118*a* and 118*b* in FIG. 1, card placement windows 718*a* and 718*b* are preferably constructed to have a relative height differential to aid in the proper registration of the overlapping face-down cards.

The unit of the embodiment of FIG. 7 as indicates of the device of FIG. 1 is sealed to prevent dust and debris from entering the housing 706. The use of clear glass is preferred as for the windows 716, 718*a* and 718*b*. However, any mar resistant, transparent sheeting that resists distortion is suitable.

Referring to FIG. 10, reflecting mechanism 1008, with two reflecting surfaces 1002*a* and 1002*b*, is located below receiving and viewing windows 718 and 716, respectively, to allow viewing mechanism 1008 to reflect or otherwise present an image of the face-down cards on windows 718 to be viewed by a player through window 716.

Although the reflecting mechanism 1008 depicted in FIG. 10 is a prism, alternative viewing or reflecting mechanisms such as a combination of coordinated mirrored surfaces may be substituted without departing from the scope of the invention. Any suitable apparatus or method for retaining in place the reflecting mechanism 1008 may be used. The invention also contemplates any conventional, suitable means (not shown) by which the angular position of the reflecting mechanism 1008 may be adjusted by the player.

The invention envisions use of a suitable number of reading units (one for each player, see FIG. 12) imbedded within a card-playing tabletop of a kind conventionally used in poker-playing establishments. The invention is admirably effective in minimizing or eliminating the ability of other players or by standing observer or by a conspirator of a competing player to identify cards dealt to a player. The damage to cards due to bending is also avoided; bending is also used by cheating players to illegally mark cards in a manner that allows cheating players to recognize the same marked cards in a subsequently dealt hand.

It will be apparent to one skilled in the art that various changes may be made to the embodiments that are described by the present invention without departing from the inventive concept disclosed. It will be understood, therefore, that the invention is not to be limited to the particular embodiments disclosed and it is intended to include modifications within the sprit and scope of the present invention as defined by the claims.

What is claimed is:

1. A device adapted for positioning below a table top for permitting a player to identify playing cards that are positioned face-down on a top surface of said device, said device comprising a top planar surface construction whereby a dealt face-down card can be slid face down onto a card placement window coplanar with the table top and a contiguous viewing window, means to provide a spaced relative positioning for viewing face down cards and such that an image of an identifying indicia of each face down card is viewable when said cards are exposed downward through the card placement window, a combination of coordinated reflecting surfaces wherein a first reflecting surface is angled relative to a second reflecting surface such that a reflection of said cards' identifying indicia reflects from said first to said second reflecting surface and whereby said player is able to view and identify said cards' indicia in normal orientation, from said such reflecting surface through said viewing window.

2. The device of claim 1 wherein said reflecting surfaces comprise a prism provided with at least two reflecting surfaces oriented in a position to identify face down cards positioned at said card placement window and to reflect an image of the identifying indicia for viewing by the player through the viewing window.

3. The device of claim 2 wherein the device is positioned within an opening of the tabletop surface such that the tabletop surface and the top planar surface of the device are substantially coplanar.

4. The device of claim 1 having the reflecting surfaces positioned within an opening in a tabletop surface such that the tabletop surface and the top planar surface of the device are substantially coplanar.

5. The device of claim 1 further comprising a sliding door atop said viewing window and arranged to be manually movable from a position covering and exposing said viewing window.

6. The device of claim 5 wherein said sliding door is spring-loaded in a closed position covering said window.

7. The device of claim 1 wherein said reflecting surfaces comprise a prism provided with at least two reflecting surfaces oriented in a position to identify face-down cards positioned at said window and to reflect an image of the identifying indicia for viewing by the player through said viewing window and wherein the device is installed in an opening of a tabletop surface such that the tabletop surface and the top planar surface of the device are substantially coplanar.

8. The device of claim 7 wherein a sliding door is spring-loaded in a position covering said viewing window.

9. A method for a player to view the identification of cards dealt face-down on a table top to the player comprising the steps of:

providing a device for positioning below a table top playing surface and containing a surface window portion substantially coplanar with the table top;

providing a reflecting system positioned below said window portion, said reflecting system comprising at least two coordinating reflecting surfaces;

sliding face-down cards on a card placement portion of said window in a position such that at least an identifying image (part) of said face-down cards is reflected downward onto the first of said reflecting surfaces and as such is reflected onto a second reflecting surface, said second reflecting surface of said reflecting system being oriented to receive a reflection of the identifying image from said first reflecting surface and to transmit (said) a reflection of said image upward for viewing by said player through a contiguous window viewing portion (of said window).

10. The method of claim 9 wherein the reflecting system comprises a prism containing at least two coordinating reflecting surfaces.

* * * * *